United States Patent [19]

von Blücher et al.

[11] Patent Number: 4,843,739

[45] Date of Patent: Jul. 4, 1989

[54] INNER SHOE MATERIAL WITH ADSORBENT PROPERTIES

[76] Inventors: Hubert von Blücher, Reytagstrasse 45, D-4000 Duesseldorf; Hasso von Blücher, Columbusstrasse 58, D-4000 Duesseldorf 1; Ernest de Ruiter, Hoehenstrasse 57a, D-5090 Leverkusen 3, all of Fed. Rep. of Germany

[21] Appl. No.: 194,054

[22] Filed: May 13, 1988

[30] Foreign Application Priority Data

May 15, 1987 [DE] Fed. Rep. of Germany ..... 3716303

[51] Int. Cl.[4] ..... A43B 13/38

[52] U.S. Cl. ..... 36/44; 428/196

[58] Field of Search ..... 36/43, 44, 55; 428/196, 428/198

[56] References Cited

U.S. PATENT DOCUMENTS

| | | | |
|---|---|---|---|
| 3,842,519 | 10/1974 | Lapidus | 36/44 |
| 3,852,897 | 12/1974 | Bridge | 36/44 |
| 4,062,131 | 12/1977 | Hsiung | 36/44 |
| 4,099,342 | 7/1978 | Singh | 36/44 |
| 4,510,193 | 4/1985 | Blucher et al. | 428/341 X |
| 4,517,308 | 5/1985 | Ehlenz et al. | 36/43 X |

*Primary Examiner*—Donald Watkins

*Attorney, Agent, or Firm*—Sprung Horn Kramer & Woods

[57] ABSTRACT

The present invention involves an inner shoe material with adsorbent properties, whereby activated carbon particles are fixed as the adsorbent material by means of an adhesive substance in a punctiform manner to the side of the material facing away from the foot. The inner shoe material of the invention can be designed as inside lining, insoles, slipsoles, as inner sole of the shoe or as a covering material for the inner sole of the shoe. The inner shoe material of the invention can e.g. be used for combat boots with integrated C-protection or for safety boots with protection against aggressive chemicals. The inner shoe material has the advantage that it exhibits a high degree of scuff resistance on the one hand and the adsorbent activated carbon is freely accessible to the substances to be adsorbed, on the other.

12 Claims, No Drawings

INNER SHOE MATERIAL WITH ADSORBENT PROPERTIES

The present invention involves an inner shoe material with adsorbent properties, whereby the adsorbent material used, e.g. to adsorb perspiration and odors, is activated carbon.

From the prior art it is known that activating carbon exhibits good adsorption properties, and in particular is suitable for adsorbing body emissions like sweat and the odors contained therein. For this reason tests have already been made to use activated carbon in some way as an adsorbent material in inner shoe material. For example, the suggestion was made to work the activated carbon into a latex foam and to manufacture shoe insoles from the thus obtained latex foam. However, it proved to be of a disadvantage that the activated carbon was no longer freely accessible to the substances to be adsorbed because it was embedded in the latex foam, so that a major part of the adsorbent effect was lost. Therefore, tests were conducted to increase the free accessibility of the activated carbon in the inner shoe material in a way that the activated carbon is less integrated into the material. This, however, led to the result that the activated carbon no longer was completely bonded by the binder, so that when the inner shoe material was rubbed its black color came off.

The problem the present invention aims to solve therefore involves creating an inner shoe material with the above mentioned adsorbent properties, the adsorbent activated carbon being freely accessible to the substances to be adsorbed on the one hand, while still possessing a high degree of scuff resistance on the other.

The solution to this problem is furnished by a inner shoe material whose activated carbon particles are fixed by means of an adhesive substance in punctiform onto the side facing away from the foot. The shoe lining material according to the invention can e.g. be placed between the upper leather and the inner lining of the shoe, between the main sole and the insole or even as an intermediate layer in a slipsole or in an inner sole. The inner shoe material can also be designed as a covering material for the inner sole of the shoe. To guarantee the desired scuff resistance preferably very hard activated carbon particles are used as the adsorbing agent for the inner shoe material of the invention. These activated carbon particles are preferably spherical or mainly spherical. The diameter of the activated carbon particles lies preferably between 0.1 mm and 1 mm.

Materials suited for the purpose of the invention are known for instance from DE-C-29 51 827, EP-B-90 073 and EP-B-118 618, whose disclosures are incorporated herein by reference. As a result of the punctiform fixation of the activated carbon particles according to EP-B-118 618 it is guaranteed that about 85% of the surface of the activated carbon is freely accessible, so that the given adsorption capacity is retained as much as possible. The application of the adhesive substance does not take place as a continuous surface application but in a punctiform manner, so that the breathing activity of the material is retained. The application of the adhesive substance can take place by rotary screen printing e.g. as described in EP-B-118 618. Here there is need for an adhesive which, in addition to high mechanical strength and elasticity as well as a certain penetration ability also has to have a sufficient initial adhesiveness to hold the scattered activated carbon globules until the strength is reached. This requirement is met by the adhesive substances described in EP-B-118 618, in particular the low-solvent or solvent-free (20 to 0%) IMPRANIL High solid PUR reactive products® from BAYER. These are NCO prepolymers, which are blocked to obtain a long potlife and which are each wetted with a predetermined amount of a diamine (e.g. IMPRAFIX HS-C).

The inner shoe material of the invention is particularly well suited for combat boots having integrated C-protection or safety boots with protection against aggressive chemicals. Sedentary combat boots pose a great danger for the feet of soldiers. For the protection against such combat substances today's ABC-protection provides special slip-over boots. It can happen, however, that these slip-over boots are damaged and are not available at the right moment. The inner shoe material of the invention helps out here, since it absorbs combat substances. Combat boots equipped with the inner shoe material of the invention therefore guarantee a considerably higher degree of safety for soldiers.

The invention will be further described in the following illustrative examples:

EXAMPLE 1

Activated spherical carbon particles of about 0,5 mm diameter are adhered to a textile fabric base by points of adhesive as described in U.S. Pat. No. 4,510,193 corresponding to EP-B-118,618. The carbon particles are applied in about 200 g/cm$^2$. The fabric is then calendered to a microporous polyurethane sheet with the carbon sandwiched between. The resultant fabric is especially suited for a combat boot lining providing anti-chemical protection.

EXAMPLE 2

For simple odor protection, as in Example 1 activated carbon particles are adhered by points of adhesive to a base fabric in a density of 70 g/m$^2$. The product is directly useful as an innersole for sport shoes. It will be understood that the specification and examples are illustrative but not imitative of the present invention and that other embodiments within the spirit and scope of the invention will suggest themselves to those skilled in the art.

What is claimed is:

1. In an inner shoe material with activated carbon to provide adsorbent properties, the improvement wherein the activated carbon is present in the form of particles fixed by means of an adhesive substance in a punctiform manner to the side of the material facing away from the foot.

2. An inner shoe material according to claim 1, wherein the activated carbon particles are spherical or nearly spherical.

3. An inner shoe material according to claim 2, wherein the activated carbon particles have a diameter between 0.1 and 1 mm.

4. An inner shoe material according to claim 1, wherein the adhesive substance is present thereon only partially and not as a continuous surface.

5. An inner shoe material according to claim 1, wherein the adhesive substance is a latex.

6. An inner shoe material according to claim 1, wherein the adhesive substance is a thermoplastic adhesive.

7. An inner shoe material according to claim 1, in the form of an inner lining of the shoe.

8. An inner shoe material according to claim 1, in the form of a shoe insole.

9. An inner shoe material according to claim 1, in the form of a slipsole for a shoe.

10. An inner shoe material according to claim 1, in the form of an inner sole or as covering material for the inner sole of a shoe.

11. A combat boot with integrated C-protection including for at least one of the inside lining, the shoe insole, the slipsole and the inner sole of the shoe, an inner shoe material according to claim 1.

12. A safety boot with protection against aggresive chemicals including for at least one of the inside lining, the shoe insole, the slipsole and the inner sole of the shoe, an inner shoe material according to claim 1.

* * * * *